United States Patent [19]

Jonkouski

[11] Patent Number: 5,016,887

[45] Date of Patent: May 21, 1991

[54] GOLF BALL

[75] Inventor: Gail C. Jonkouski, Chicago, Ill.

[73] Assignee: Wilson Sporting Goods Co., River Grove, Ill.

[21] Appl. No.: 534,128

[22] Filed: Jun. 5, 1990

[51] Int. Cl.[5] ..... A63B 37/14

[52] U.S. Cl. ..... 273/232; 273/218

[58] Field of Search ..... 273/232, 220, 218, 62; 40/327

[56] References Cited

U.S. PATENT DOCUMENTS 4,560,168 12/1985 Aoyama ..... 273/232

4,979,747 12/1990 Jankouski ..... 273/232

*Primary Examiner*—George J. Marlo

[57] ABSTRACT

A golf ball is provided with evenly and uniformly distributed dimples in a pattern which is governed by repeating polygons such as icosahedral triangles. The dimples are spherical in shape and the aspect ratio of all of the dimples is substantially constant, preferably 0.050. The largest dimples are located just inside the vertexes of the polygons, and the next largest dimples are located at the vertexes so that they are surrounded by the largest sized dimples.

7 Claims, 13 Drawing Sheets

---- GREAT CIRCLE

——— ICOSAHEDRAL TRIANGLE BOUNDARY

| DIMPLE POSITION | CHORD (IN.) | DEPTH (IN.) |
|---|---|---|
| 1 | .155 | .0078 |
| 2 | .150 | .0075 |
| 3 | .140 | .0070 |
| 4 | .135 | .0068 |
| 5 | .125 | .0063 |

PRIOR ART

---- GREAT CIRCLE

——— ICOSAHEDRAL TRIANGLE BOUNDARY

| DIMPLE POSITION | CHORD (IN.) | DEPTH (IN.) |
|---|---|---|
| 1 | .135 | .0070 |
| 2 | .135 | .0070 |
| 3 | .135 | .0070 |
| 4 | .135 | .0070 |
| 5 | .135 | .0070 |
| 6 | .135 | .0070 |
| 7 | .135 | .0070 |

PRIOR ART

PRIOR ART

---- GREAT CIRCLE

——— ICOSAHEDRAL TRIANGLE BOUNDARY

| DIMPLE POSITION | CHORD (IN.) | DEPTH (IN.) |
|---|---|---|
| 1 | .155 | .0071 |
| 2 | .150 | .0069 |
| 3 | .140 | .0064 |
| 4 | .135 | .0062 |
| 5 | .125 | .0058 |

PRIOR ART

GREAT CIRCLE

ICOSAHEDRAL TRIANGLE BOUNDARY

| DIMPLE POSITION | CHORD (IN.) | DEPTH (IN.) |
|---|---|---|
| 1 | .155 | .0050 |
| 2 | .150 | .0052 |
| 3 | .140 | .0054 |
| 4 | .135 | .0056 |
| 5 | .125 | .0060 |

---- GREAT CIRCLE

——— ICOSAHEDRAL TRIANGLE BOUNDARY

| DIMPLE POSITION | CHORD (IN.) | DEPTH (IN.) |
|---|---|---|
| 1 | .155 | .0078 |
| 2 | .150 | .0075 |
| 3 | .140 | .0070 |
| 4 | .135 | .0068 |
| 5 | .125 | .0063 |

---- GREAT CIRCLE

——— ICOSAHEDRAL TRIANGLE BOUNDARY

| DIMPLE POSITION | CHORD (IN.) |
|---|---|
| 1 | .100 |
| 2 | .170 |
| 3 | .110 |
| 4 | .170 |
| 5 | .170 |
| 6 | .110 |
| 7 | .125 |

---- GREAT CIRCLE

——— ICOSAHEDRAL TRIANGLE BOUNDARY

| DIMPLE POSITION | CHORD (IN.) |
|---|---|
| 1 | .110 |
| 2 | .160 |
| 3 | .135 |
| 4 | .140 |
| 5 | .150 |
| 6 | .120 |
| 7 | .120 |

---- GREAT CIRCLE

——— ICOSAHEDRAL TRIANGLE BOUNDARY

| DIMPLE POSITION | CHORD (IN.) |
|---|---|
| 1 | .100 |
| 2 | .170 |
| 3 | .120 |
| 4 | .170 |
| 5 | .170 |
| 6 | .120 |
| 7 | .120 |

GREAT CIRCLE

ICOSAHEDRAL TRIANGLE BOUNDARY

| DIMPLE POSITION | CHORD (IN.) |
|---|---|
| 1 | .100 |
| 2 | .170 |
| 3 | .130 |
| 4 | .160 |
| 5 | .120 |
| 6 | .140 |
| 7 | .170 |

GOLF BALL

BACKGROUND

This invention relates to a golf ball, and, more particularly, to a golf ball which is provided with a new and unique dimple pattern which provides excellent distance and accuracy.

This invention represents an improvement over the golf ball dimple patterns which are described in U.S. Pat. No. 4,560,168 and the golf ball dimple patterns which are used on the commercial golf balls sold under the name Wilson Staff and TC$^2$.

U.S. Pat. No. 4,560,168 describes various icosahedral dimple patterns in which the dimples are arranged so that they do not intersect the six great circles which bisect the sides of the icosahedral triangles. The dimple pattern illustrated in FIGS. 8A and 8B is used on commercial golf balls which are sold under the name Ultra. The Ultra golf ball is a two-piece golf ball which consists of a solid core and a cover. The Ultra dimple pattern includes 432 dimples, and each dimple has the same diameter and depth.

Other figures of U.S. Pat. No. 4,560,168 illustrate using dimples of various sizes on the same ball. The aspect ratio of a dimple is determined by dividing the depth of the dimple by the diameter of the dimple, and column 4, lines 42–45 state that the aspect ratio should be about 0.047 to 0.060, the optimum being about 0.052.

The Wilson Staff golf ball is a three-piece golf ball which includes a solid core, a layer of elastic windings which are wrapped around the core, and a cover. The dimple pattern of the Wilson Staff ball is a 432 dimple pattern which is similar to the Ultra pattern except that there are five different sized dimples and the dimples are frusto-conical rather than spherical. The five dimple diameters are 0.155, 0.150, 0.140, 0.135, and 0.125 inches. The depths of the dimples are 0.0071, 0.0069, 0.0064, 0.0062, and 0.0058 inches, respectively. The aspect ratio for each of the Wilson Staff dimples is therefore 0.046.

The Wilson Staff dimples are frusto-conical rather than spherical, i.e., the side surface of each dimple is formed by the frustum of a cone or a truncated cone rather than by a portion of a sphere. Prior golf balls sold under the name Pro Staff also utilized frusto-conical dimples. The bottom surface of each Wilson Staff dimple is flat and the depth of the dimple is measured to the bottom surface.

A dimple pattern formed by frusto-conical dimples having different diameters and a constant aspect ratio performs satisfactorily when used on a three-piece golf ball such as the Wilson Staff ball. However, such a dimple pattern does not perform satisfactorily when used on a two-piece ball. When the Wilson Staff dimple pattern is used on a two-piece ball having the same construction as an Ultra golf ball, the resulting ball is significantly shorter than the commercial Ultra ball in both carry and total distance (carry plus roll).

However, when the depth of the dimples increases as the diameter of the dimples decreases, a two-piece ball with frusto-conical dimples performs well. The Wilson TC$^2$ golf ball is a two-piece ball with truncated cone dimples which utilizes that principle.

In the golf ball described in U.S. Pat. No. 4,560,168 and in the Wilson Staff and TC$^2$ golf balls, the dimples are arranged so that various sized dimples are located throughout the icosahedral pattern. For example, in FIGS. 11A and 11B of the patent the largest dimples are located at dimple positions 3 and 4. In the Wilson Staff and TC$^2$ balls the largest dimples are located just inside the apexes of the icosahedral triangles.

SUMMARY OF THE INVENTION

I have found that excellent results can be obtained with a dimple pattern which utilizes spherical dimples having different diameters but a constant aspect ratio, preferably about 0.050. The largest size dimples are located just inside and on the vertices of the polygon on which the dimple pattern is based, e.g., a triangle for an icosahedral pattern and a pentagon for a dodecahedral pattern.

DESCRIPTION OF THE DRAWING

The invention will be explained in conjunction with an illustrative embodiment shown in the accompanying drawings, in which.

DESCRIPTION OF SPECIFIC EMBODIMENTS

Figure 1:
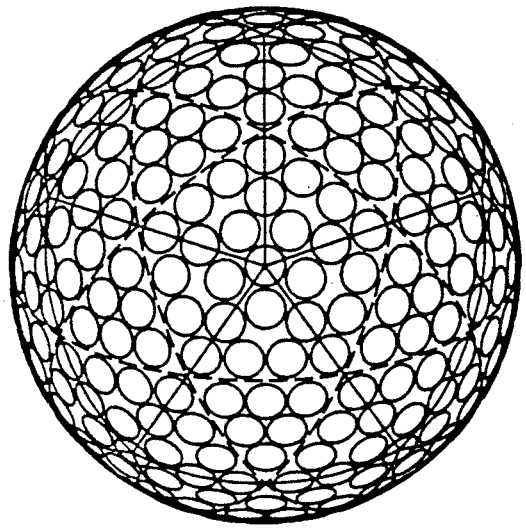
FIG. 1 is a polar view of a prior art golf ball sold under the name Ultra.
Figure 2:
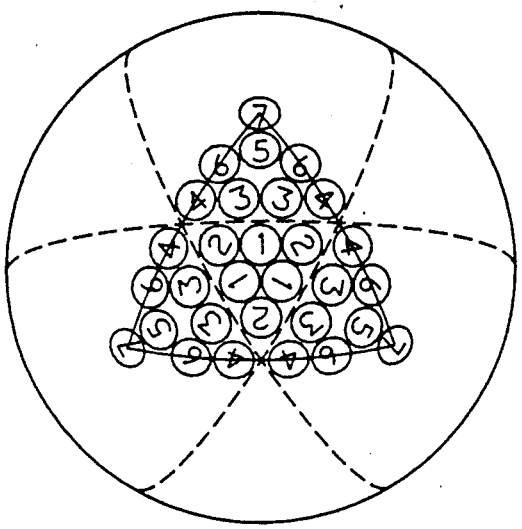
PRIOR ART FIG. 2
FIG. 2 illustrates one of the icosahedral triangles of the prior art golf ball of FIG. 1 and lists the dimple diameter or chord and the depth for each dimple.

FIGS. 1 and 2 represent the dimple pattern of the prior art two-piece Ultra golf ball and are essentially reproductions of FIGS. 8A and 8B of U.S. Pat. No. 4,560,168. As explained in that patent, the dimples are arranged in an icosahedral pattern, and the solid lines in FIGS. 1 and 2 represent the sides of icosahedral triangles. The dashed lines are six great circles which bisect the sides of the icosahedral triangles. The dimples are arranged so that they do not intersect the six great circles.

All of the dimples in the prior art ball illustrated in FIGS. 1 and 2 have a constant diameter of 0.135 inch and a constant depth of 0.007 inch. The aspect ratio of the depth divided by the diameter is 0.052.

Figure 3:
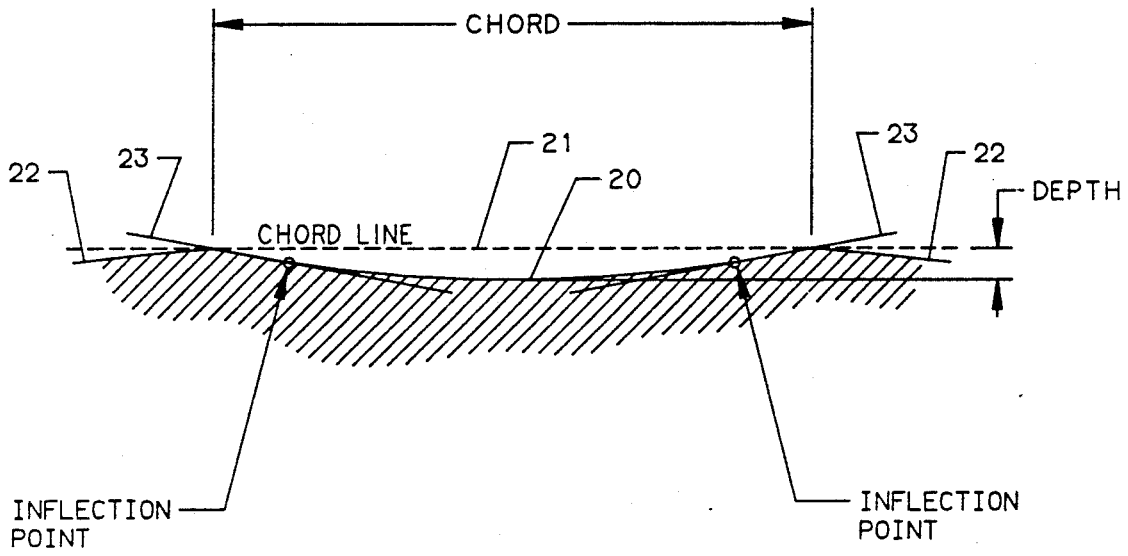
FIG. 3 illustrates the method of determining the dimple diameter or chord and the depth of a dimple.

FIG. 3 illustrates the method of determining the dimple diameter or chord and the depth of a dimple 20 as the terms "diameter" and "depth" are used herein. A chord line 21 is drawn tangent to the spherical ball surface 22 on opposite sides of the dimple. Side wall lines 23 are drawn tangent to the dimple walls at the inflection points of the wall, i.e., where the curvature of the wall changes sign or where the second derivative of the equation for the curve is 0. The intersections of the side wall lines 23 and the chord line 21 define the edges of the dimple and the chord or diameter of the dimple. The depth of the dimple is measured between the chord line and the bottom of the dimple at its center. For a dimple in the shape of a truncated cone, the inflection point is actually a line segment of a discrete length.

Figure 4:
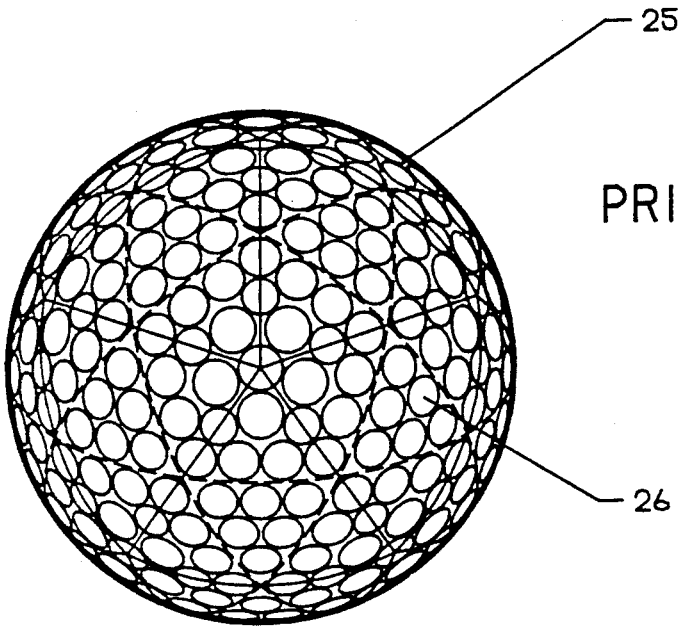
FIG. 4 is a polar view of a prior art golf ball sold under the name Wilson Staff.
Figure 5:
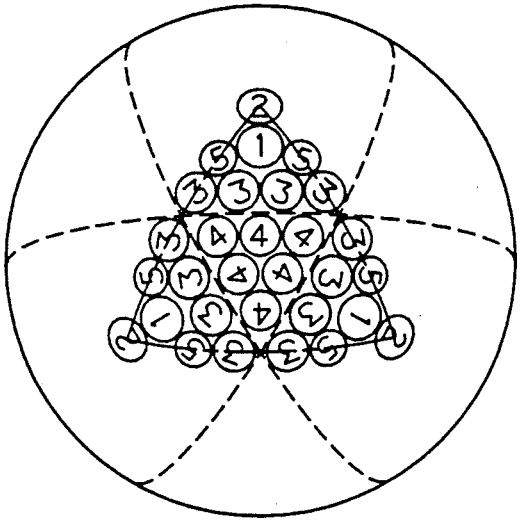
PRIOR ART FIG. 5
FIG. 5 illustrates one of the icosahedral triangles of the prior art golf ball of FIG. 4 and lists the dimple diameter or chord and the depth for each dimple.

FIGS. 4 and 5 represent the dimple pattern of the prior art three-piece Wilson Staff golf ball 25. The dimples 26 are arranged in an icosahedral pattern and do not intersect the six great circles which bisect the sides of the icosahedral triangles. There are five different sizes of dimples represented by the dimples numbered 1 through 5 in FIG. 5, and all dimples have the same aspect ratio of 0.046. The diameters and depths of the dimples are set forth in Table I.

TABLE I

| Dimple No. | Diameter (in.) | Depth (in.) | Aspect Ratio |
|---|---|---|---|
| 1 | 0.155 | 0.0071 | 0.046 |
| 2 | 0.150 | 0.0069 | 0.046 |
| 3 | 0.140 | 0.0064 | 0.046 |
| 4 | 0.135 | 0.0062 | 0.046 |
| 5 | 0.125 | 0.0058 | 0.046 |

Figure 6:
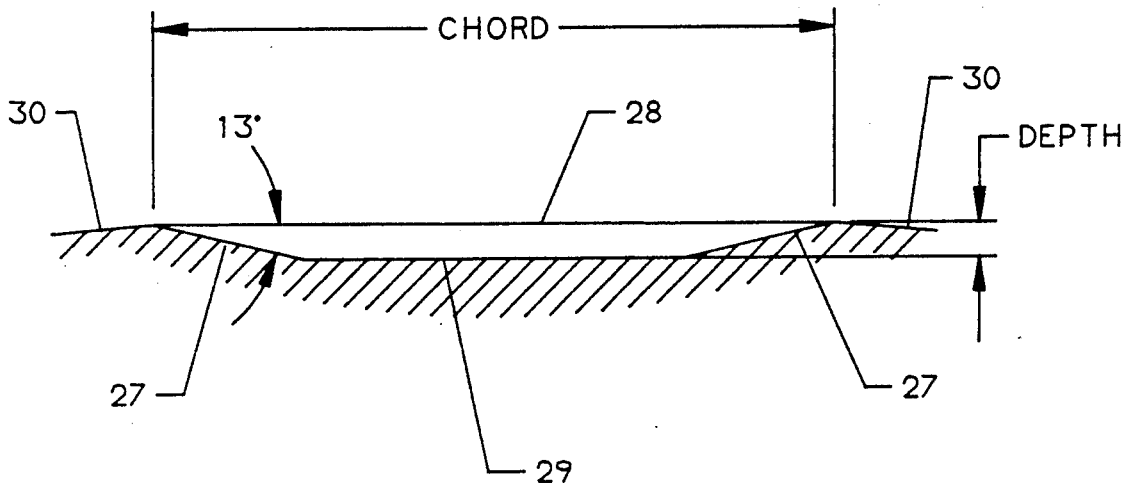
FIG. 6 is a fragmentary cross sectional view through one of the dimples of the prior art golf ball of FIG. 4.

Referring to FIG. 6, the dimples of the Wilson Staff ball are frusto-conical or in the shape of a truncated cone. Each dimple has a conical side surface 27, and the inclination of the side surface relative to the chord line 28 is 13 degrees. Each dimple has a flat bottom surface 29 which extends parallel to the chord line 28. The depth of the dimple is measured from the chord line 28 to the bottom surface 29. The radius of the spherical outer surface 30 is about 0.84 inch.

Figure 7:
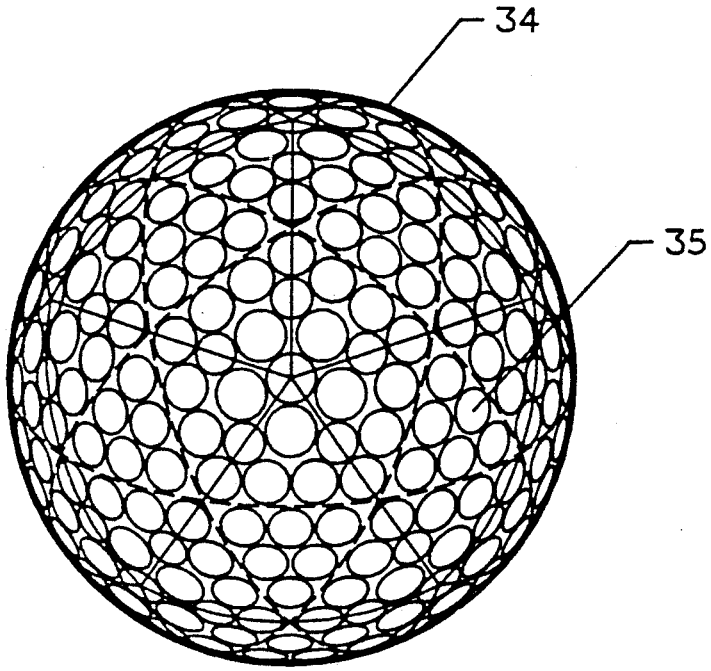
FIG. 7 is a polar view of a prior art golf ball sold under the name Wilson TC$^2$.
Figure 8:
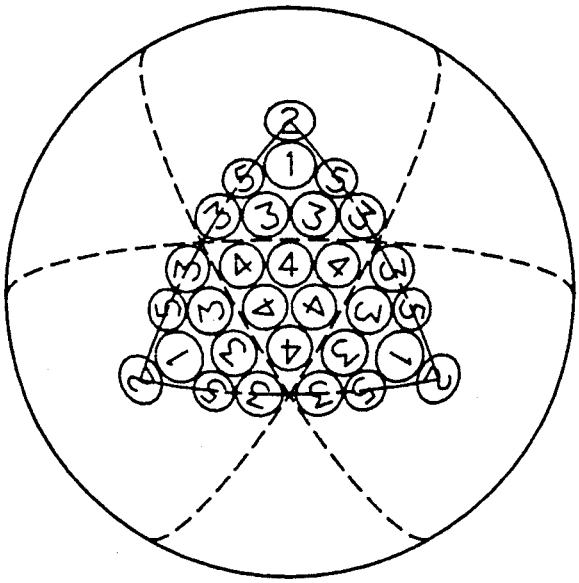
FIG. 8 illustrates one of the icosahedral triangles of the prior art golf ball of FIG. 7 and lists the dimple diameter or chord and the depth for each dimple.

FIGS. 7 and 8 represent the dimple pattern of the prior art two-piece $TC^2$ golf ball 34. The dimples 35 are arranged in an icosahedral pattern and do not intersect the six great circles which bisect the sides of the icosahedral triangles. There are five different sizes of dimples represented by the dimples numbered 1 through 5 in FIG. 8. The depths of the dimples increase as the diameters decrease, and the aspect ratios also increase as the diameter decreases. The measurements of the dimples in FIGS. 7 and 8 are set forth in Table II.

TABLE II

| Dimple No. | Diameter (in.) | Depth (in.) | Aspect Ratio |
|---|---|---|---|
| 1 | 0.155 | 0.0050 | 0.032 |
| 2 | 0.150 | 0.0052 | 0.035 |
| 3 | 0.140 | 0.0054 | 0.039 |
| 4 | 0.135 | 0.0056 | 0.042 |
| 5 | 0.125 | 0.0060 | 0.048 |

Figure 9:
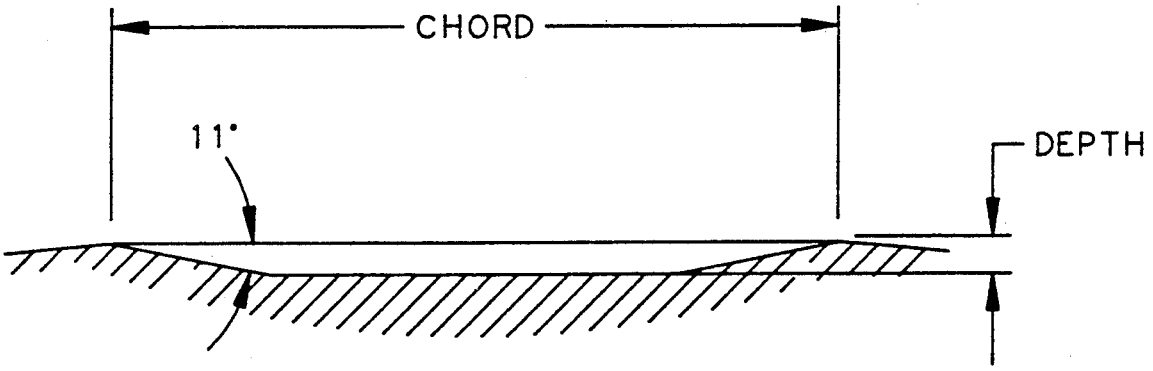
FIG. 9 is a fragmentary cross sectional view through one of the dimples of the prior art golf ball of FIG. 7.

Referring to FIG. 9, the dimples of the Wilson $TC^2$ ball have the shape of truncated cones. The inclination of the conical side surface relative to the chord line is 11 degrees.

Figure 10:
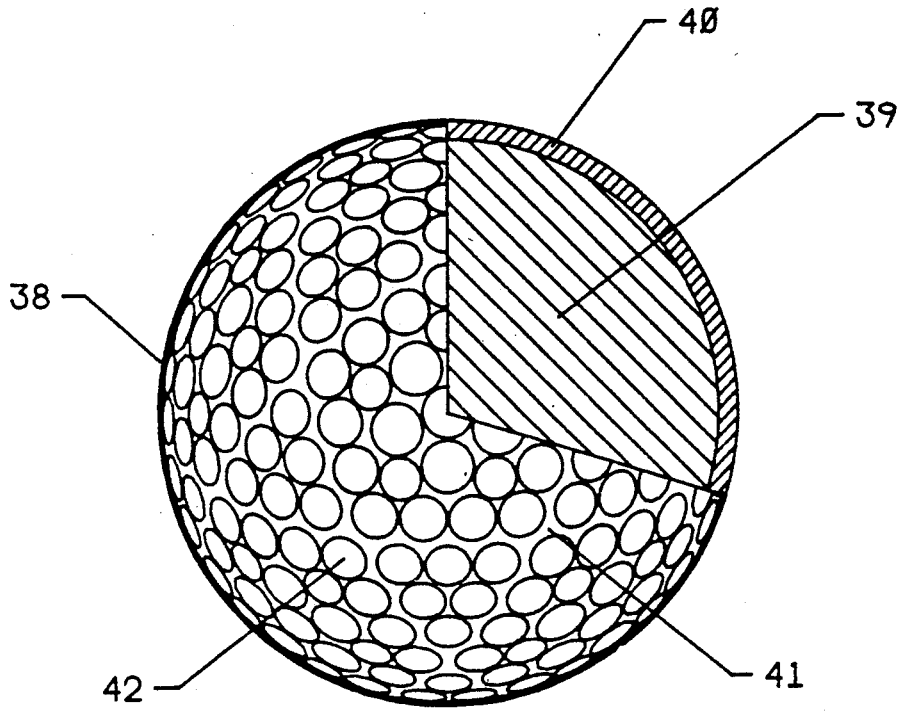
FIG. 10 is a perspective view, partially broken away, of a golf ball formed in accordance with the invention.

The inventive dimple pattern is illustrated in FIGS. 10–13. FIG. 10 shows a two-piece golf ball 38 consisting of a solid core 39 and a cover 40. The cover has an outer spherical surface 41 and a plurality of recessed dimples 42.

Figure 11:
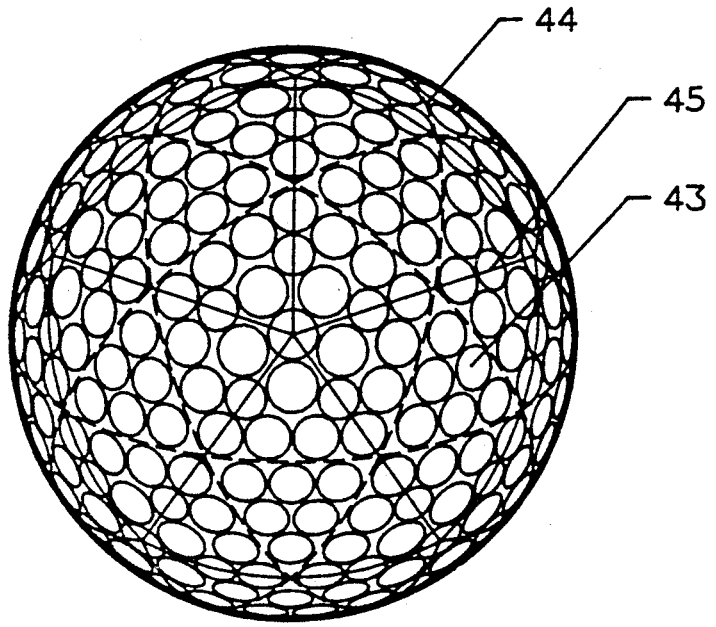
FIG. 11 is a polar view of a golf ball formed in accordance with the invention.
Figure 12:
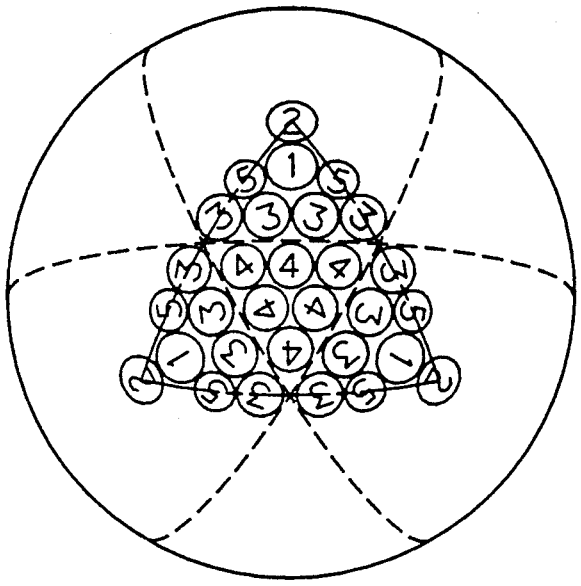
FIG. 12 illustrates one of the icosahedral triangles of the golf ball of FIG. 11 and lists the dimple diameter or chord and the depth for each dimple.

The particular embodiment illustrated in FIGS. 11 and 12 includes 432 dimples 43 arranged in an icosahedral pattern. The dimples do not intersect the six great circles 44 which bisect the sides of the icosahedral triangles 45. There are five different sizes of dimples as indicated in FIG. 12.

Figure 13:
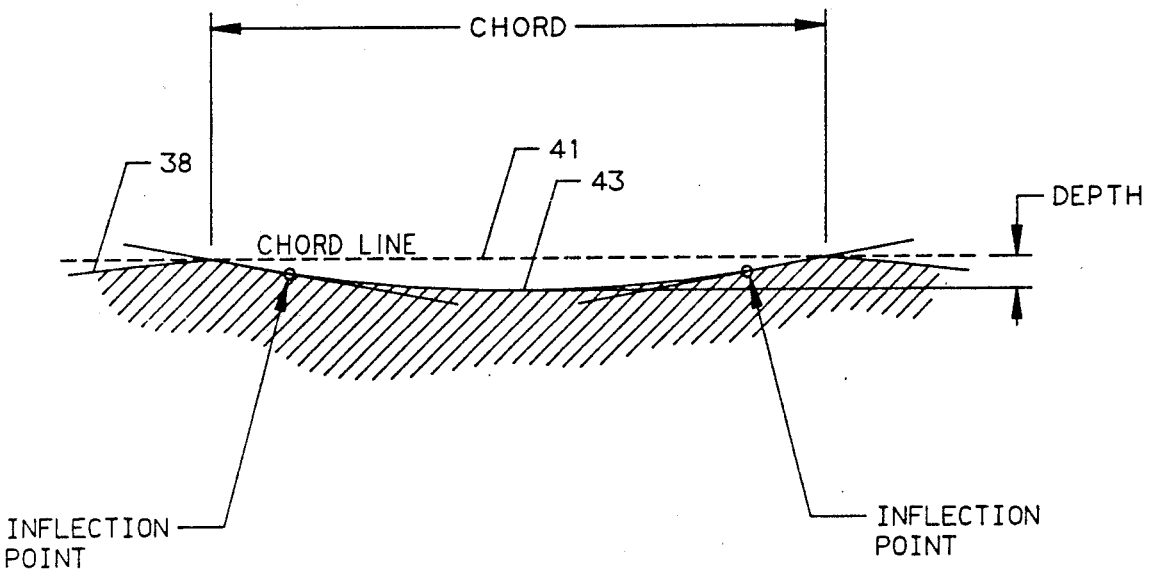
FIG. 13 is a fragmentary cross sectional view through one of the dimples of FIG. 11.

The diameters of the dimples in FIG. 12 are the same as for the Wilson Staff and Wilson $TC^2$ prior art balls. However, unlike the two-piece Wilson $TC^2$ ball, the depths of the dimples in FIGS. 10–13 increase as the diameters increase. Unlike the three-piece Wilson Staff ball, which has an aspect ratio of 0.046, the aspect ratio of the inventive ball is constant at 0.050. Each dimple is in the shape of a sphere as illustrated in FIG. 13 rather than a truncated cone as in the Wilson Staff and $TC^2$ balls. The depth of each dimple is measured from the chord line 46 to the bottom of the dimple. The measurements of the dimples in FIGS. 10–13 are set forth in Table III.

TABLE III

| Dimple No. | Diameter (in.) | Depth (in.) | Aspect Ratio |
|---|---|---|---|
| 1 | 0.155 | 0.0078 | 0.050 |
| 2 | 0.150 | 0.0075 | 0.050 |
| 3 | 0.140 | 0.0070 | 0.050 |
| 4 | 0.135 | 0.0068 | 0.050 |
| 5 | 0.125 | 0.0063 | 0.050 |

Referring to FIGS. 11 and 12, the largest sized dimples are at dimple positions 1 and 2. The largest dimples are located at dimple position No. 1, which lies just inside the included angle formed by each apex of the icosahedral triangle and is tangent or almost tangent to the sides of the icosahedral triangle. The next largest dimple is at position No. 2 at each of the apexes of the icosahedral triangle. All of the other dimples are smaller.

Referring to FIG. 11, the six great circles define 12 pentagons and 20 small triangles, forming what is sometimes called an icosadodecahedron pattern. The apexes of five icosahedral triangles meet at the center of each pentagon. Dimple position No. 2 is in the center of each pentagon, and each No. 2 dimple is surrounded by five No. 1 dimples.

The prior art Staff and $TC^2$ balls illustrated in FIGS. 4 and 5 and 7 and 8 have the same arrangement of dimples as that illustrated in FIGS. 11 and 12. However, dimples of the Staff and $TC^2$ balls were truncated cones rather than portions of spheres, and the dimples did not have a constant aspect ratio of 0.050.

FIGS. 14–20 illustrate the dimple patterns of four sample golf balls which were made in order to find the optimum dimple pattern. The dimple pattern of FIGS. 14 and 15 has four different sized dimples with a constant aspect ratio of 0.052. The largest dimples are located in dimple position Nos. 2, 4, and 5.

Figure 16:
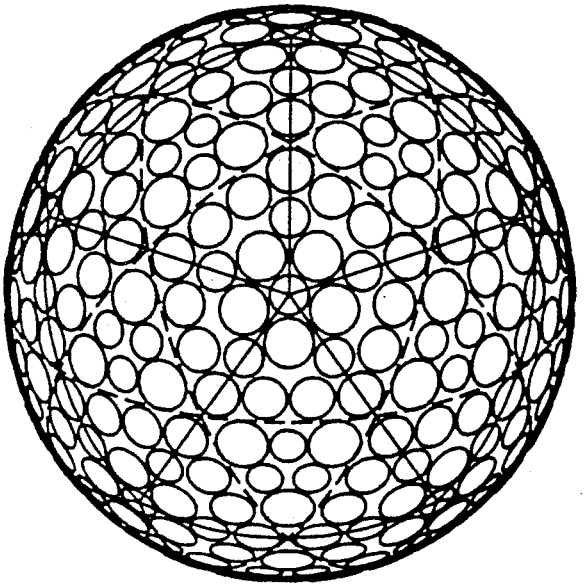
Figure 17:
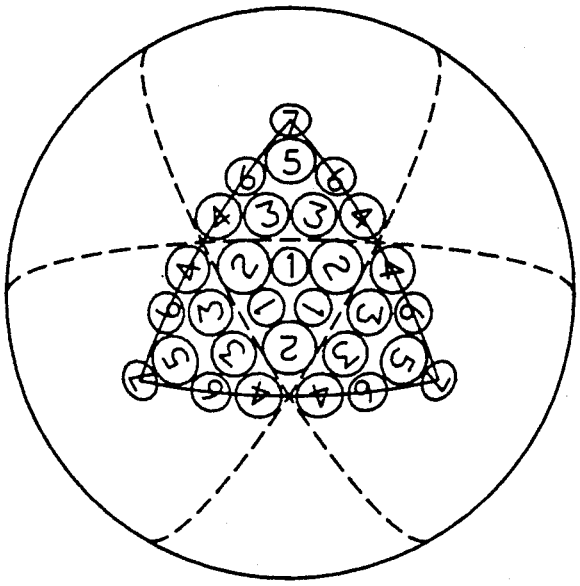

The dimple pattern of FIGS. 16 and 17 has six different sized dimples with a constant aspect ratio of 0.052. The biggest dimples are located in dimple position No. 2.

Figure 18:
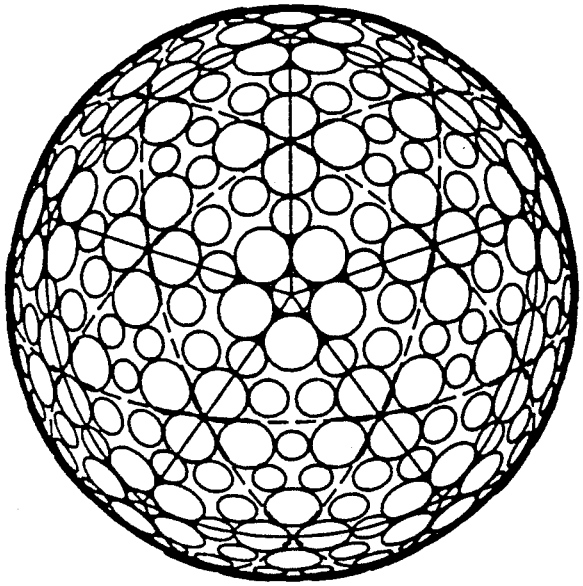
Figure 19:
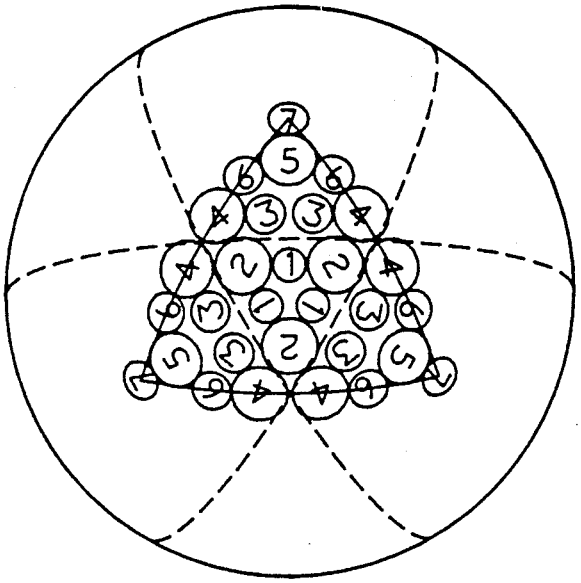

The dimple pattern of FIGS. 18 and 19 has three different sized dimples with a constant aspect ratio of 0.052. The biggest dimples are located in dimple position Nos. 2, 4, and 5.

Figure 20:
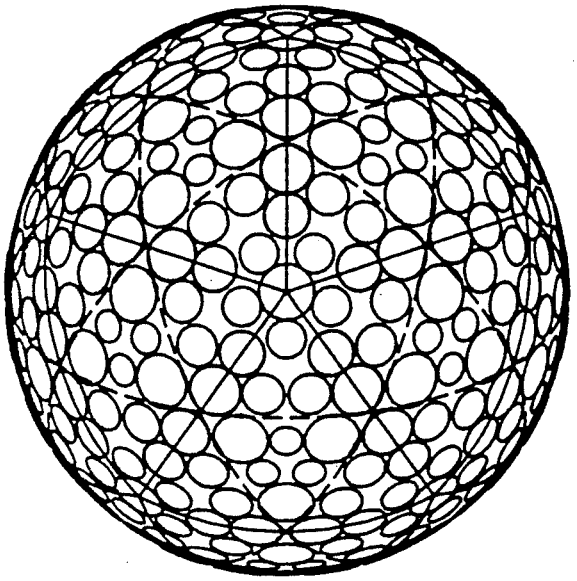
Figure 21:
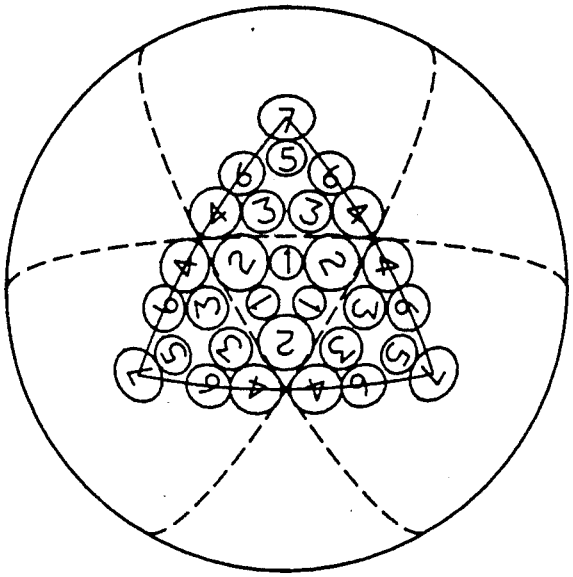

The dimple pattern of FIGS. 20 and 21 has six different sized dimples with a constant aspect ratio of 0.052. The biggest dimples were located in dimple position Nos. 2 and 7.

The performance of the dimple pattern illustrated in FIGS. 10–13 was demonstrated by comparative tests referred to in Tables IV and V in which the Ultra commercial golf ball was used as the control. All of the balls were two-piece balls which had 432 spherical dimples. Sample Nos. 1 and 6 were injection molded, and Sample Nos. 1A and 2–5 were compression molded.

Sample No. 1 was the Ultra prior art golf ball in which the chord and depth was the same for all dimples. Sample No. 1A used the same dimple pattern but was compression molded. Sample No. 2 used the dimple pattern illustrated in FIGS. 14 and 15. Sample No. 3 used the dimple pattern illustrated in FIGS. 16 and 17. Sample No. 4 used the dimple pattern illustrated in FIGS. 18 and 19. Sample No. 5 used the dimple pattern illustrated in FIGS. 20 and 21. Sample No. 6 used the dimple pattern illustrated in FIGS. 10–13. Table IV includes the dimple information for the samples.

TABLE IV

| Sample | Chord (in.) | Depth (in.) | Aspect Ratio | Dimple Shape |
|---|---|---|---|---|
| No. 1 (Ultra) | 0.135 | 0.0070 | 0.052 | Spherical |
| No. 1A | 0.135 | 0.0070 | 0.052 | Spherical |
| No. 2 | 0.170 | 0.0088 | 0.052 | Spherical |
| | 0.125 | 0.0065 | | |
| | 0.110 | 0.0057 | | |
| | 0.100 | 0.0052 | | |
| No. 3 | 0.160 | 0.0083 | 0.052 | Spherical |
| | 0.150 | 0.0078 | | |
| | 0.140 | 0.0073 | | |
| | 0.135 | 0.0070 | | |
| | 0.110 | 0.0057 | | |
| | 0.120 | 0.0062 | | |
| No. 4 | 0.170 | 0.0088 | 0.052 | Spherical |
| | 0.120 | 0.0062 | | |
| | 0.100 | 0.0052 | | |
| No. 5 | 0.170 | 0.0088 | 0.052 | Spherical |
| | 0.160 | 0.0083 | | |
| | 0.140 | 0.0073 | | |
| | 0.130 | 0.0068 | | |
| | 0.120 | 0.0062 | | |
| | 0.100 | 0.0052 | | |
| No. 6 | 0.155 | 0.0078 | 0.050 | Spherical |
| | 0.150 | 0.0075 | | |
| | 0.140 | 0.0070 | | |
| | 0.135 | 0.0068 | | |
| | 0.125 | 0.0063 | | |

Sample No. 1 was used as a control for Sample No. 6. Both balls were injection molded. Sample No. 1A was used as a control for Sample Nos. 2–5. These balls were compression molded. Table V compares the average carry distance and total distance in yards for Sample Nos. 2–6. The number shown in the table is the difference in yards between that ball's distance and that of its control. Thirty balls of each sample were hit with a True-Temper golf machine using a metal driver and a club head speed of 150 feet per second. Only the balls which landed in the fairway were measured.

TABLE V

| Sample | No. 2 | No. 3 | No. 4 | No. 5 | No. 6 |
|---|---|---|---|---|---|
| Carry Avg. Diff. from Control | 0.2 | −0.8 | −1.8 | −2.6 | 2.0 |
| Total Avg. Diff. from Control | −4.6 | −3.3 | −4.2 | −5.1 | 5.2 |

TABLE V-continued

Table V indicates that the only sample which was longer in total distance than its control was Sample No. 6, which was formed in accordance with the invention. The primary difference between Sample No. 6 and Sample Nos. 2–5 was the location of the largest sized dimples. Referring to FIGS. 11 and 12, in Sample No. 6 the largest sized dimples were in dimple position No. 1, which was in each of the corners or vertexes of the icosahedral triangles. The next largest sized dimple was in dimple position No. 2, which was at each of the vertexes of the icosahedral triangles and which was surrounded by No. 1 dimples. The dimples in dimple position No. 2 were just slightly smaller than the dimples in dimple position No. 1, and all of the other dimples were smaller than dimple Nos. 1 and 2.

Figure 14:
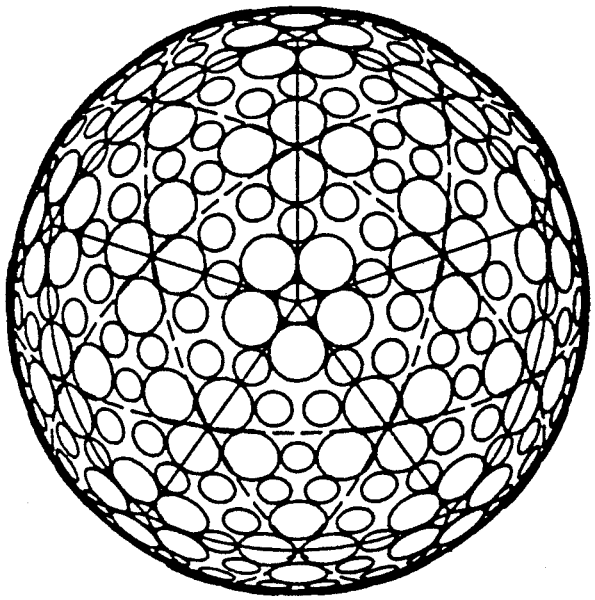
FIGS. 14 through 21 are views similar to FIGS. 11 and 12 which show slightly different dimple patterns than FIGS. 11 and 12 and which establish the superiority of the dimple pattern of FIGS. 11 and 12.
Figure 15:
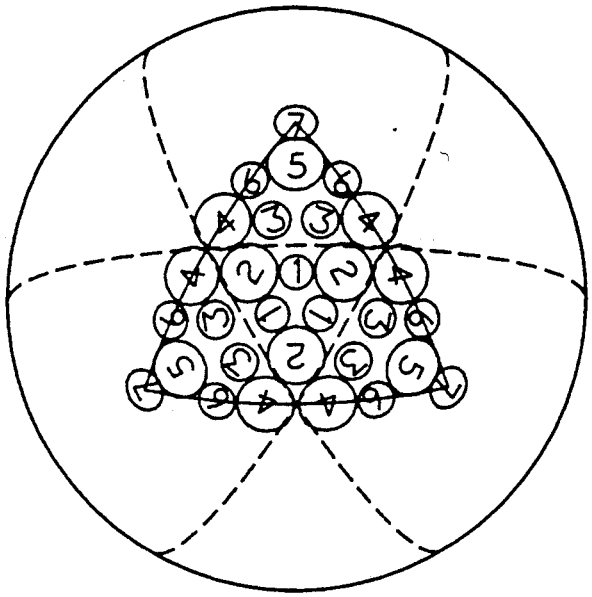

Comparing FIG. 11 with FIGS. 14, 16, 18, and 20, the dimple patterns in FIGS. 14, 16, and 18 also have a dimple located at the vertex of five adjacent icosahedral triangles which are surrounded by five larger dimples. However, FIGS. 14, 16, and 18 are different from FIG. 13 in at least one of several ways: either the five surrounding dimples are not the largest sized dimples, other dimples are at least as large, the center or surrounded dimple is not the next largest sized dimple, etc. In FIG. 20, the center dimple is surrounded by dimples that are not the largest-sized dimples.

Referring again to FIGS. 11 and 12, the largest sized dimples, dimples no. 1, form a cluster of five dimples which surround the next largest sized dimple, dimple No. 2. The chord or diameter of dimple No. 2 is 96.8% of the chord or diameter of dimple No. 1. The chord or diameter of dimple No. 3 is 90.3% of the diameter of dimple No. 1, the diameter of dimple No. 4 is 87.1% of the diameter of dimple No. 1, and the diameter of dimple No. 5 is 80.6% of the diameter of dimple No. 1.

The dimple pattern of Sample No. 6 also differs from the dimple patterns of Samples Nos. 1–5 by having a constant aspect ratio of 0.050 rather than 0.052.

Comparing FIGS. 11 and 12 with the dimple patterns of the prior art Wilson Staff and $TC^2$ golf balls illustrated in FIGS. 4 and 5 and 7 and 8, the dimple patterns of the prior art Staff and $TC^2$ balls also have a cluster of the five largest dimples, dimple No. 1, surrounding the next largest sized dimple, dimple No. 2, and the dimples have the same diameter as the dimples of the inventive pattern. However, the aspect ratio of the Wilson Staff dimples was 0.046. The aspect ratios of the $TC^2$ dimples varied, the aspect ratio increasing as the diameter of the dimples decreased. Also, the Staff and $TC^2$ dimples were truncated cones rather than portions of spheres.

All dimple dimensions referred to herein refer to the mold dimensions or, equivalently, to an unfinished ball as it comes out of the mold rather than to a painted or otherwise finished ball. The balls are finished in the conventional manner.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A two-piece golf ball comprising a core and a cover having a spherical surface with a plurality of sets of spherical dimples formed therein, the dimples of each set having a circular periphery of a different diameter and having a different depth than the dimples of the other sets, the aspect ratio of all of the dimples being substantially the same, the dimples being arranged by dividing the spherical surface into a plurality of regular polygons, each polygon having a plurality of vertexes which are formed by the sides of the polygons, the largest dimples being located just inside each of the vertexes and the next largest sized dimples being located at the vertexes.

2. The golf ball of claim 1 in which the aspect ratio of all of the dimples is about 0.050.

3. The golf ball of claim 1 in which the diameter of the largest sized dimple is about 0.155 inch and the diameter of the next largest sized dimple is about 0.150 inch.

4. The golf ball of claim 3 in which the aspect ratio of all of the dimples is about 0.050.

5. The golf ball of claim 1 in which said regular polygons are icosahedral triangles, and each of the second largest sized dimples is surrounded by five of the largest sized dimples.

6. The golf ball of claim 5 in which the diameter of the largest sized dimple is about 0.155 inch and the diameter of the next largest sized dimple is about 0.150 inch.

7. The golf ball of claim 5 in which the aspect ratio of all of the dimples is about 0.050.

* * * * *